US006659462B1

(12) United States Patent
Scott

(10) Patent No.: US 6,659,462 B1
(45) Date of Patent: Dec. 9, 2003

(54) GAME AND GAME TABLE

(76) Inventor: Timothy J. Scott, 24375 Jackson Ave., V109, Murietta, CA (US) 92562

( * ) Notice: Subject to any disclaimer, the term of this patent is extended or adjusted under 35 U.S.C. 154(b) by 0 days.

(21) Appl. No.: 10/094,525

(22) Filed: Mar. 11, 2002

(51) Int. Cl.[7] ..... A63F 3/00
(52) U.S. Cl. ..... 273/274; 273/142 HA
(58) Field of Search ..... 463/1–9, 11–20, 463/40–42; 273/142 E, 142 F, 142 G, 274, 292, 143 D, 141 R, 142 H, 142 HA, 142 J, 142 JA

(56) References Cited

U.S. PATENT DOCUMENTS 5,184,821 A * 2/1993 Korenek ..... 273/138.2
5,911,418 A * 6/1999 Adams ..... 273/274
2002/0037765 A1 * 3/2002 Johnson ..... 463/17
2002/0195773 A1 * 12/2002 Dunn ..... 273/274
2002/0198038 A1 * 12/2002 Adams ..... 463/20
2003/0011127 A1 * 1/2003 Vancura

* cited by examiner

*Primary Examiner*—William M. Pierce

(57) ABSTRACT

The player places first and second antes for the first and second phases of the game. If the first two cards dealt to any player is a key number total of 13, 14, 15 or 16, then the second phase of the game is opened to all players. The first phase is played out with each player attempting to reach a higher card total than the dealer, but less than twenty-two. If the second phase is opened by the key number in the first phase, it is played with a winner wheel, an odds wheel and a betting section on the table. The winner wheel has twenty-nine segments—one for each letter of the alphabet plus a house segment. There are corresponding bet placement areas on the betting section of the table, and there are payoff odds for each betting section. In addition, there is an odds wheel with a plurality of segments which indicate payoff odds. Both wheels are spun at the same time, and payoffs are in accordance with the indicated winner wheel segment times the odds wheel payoff multiplier.

20 Claims, 5 Drawing Sheets

Fig. 4
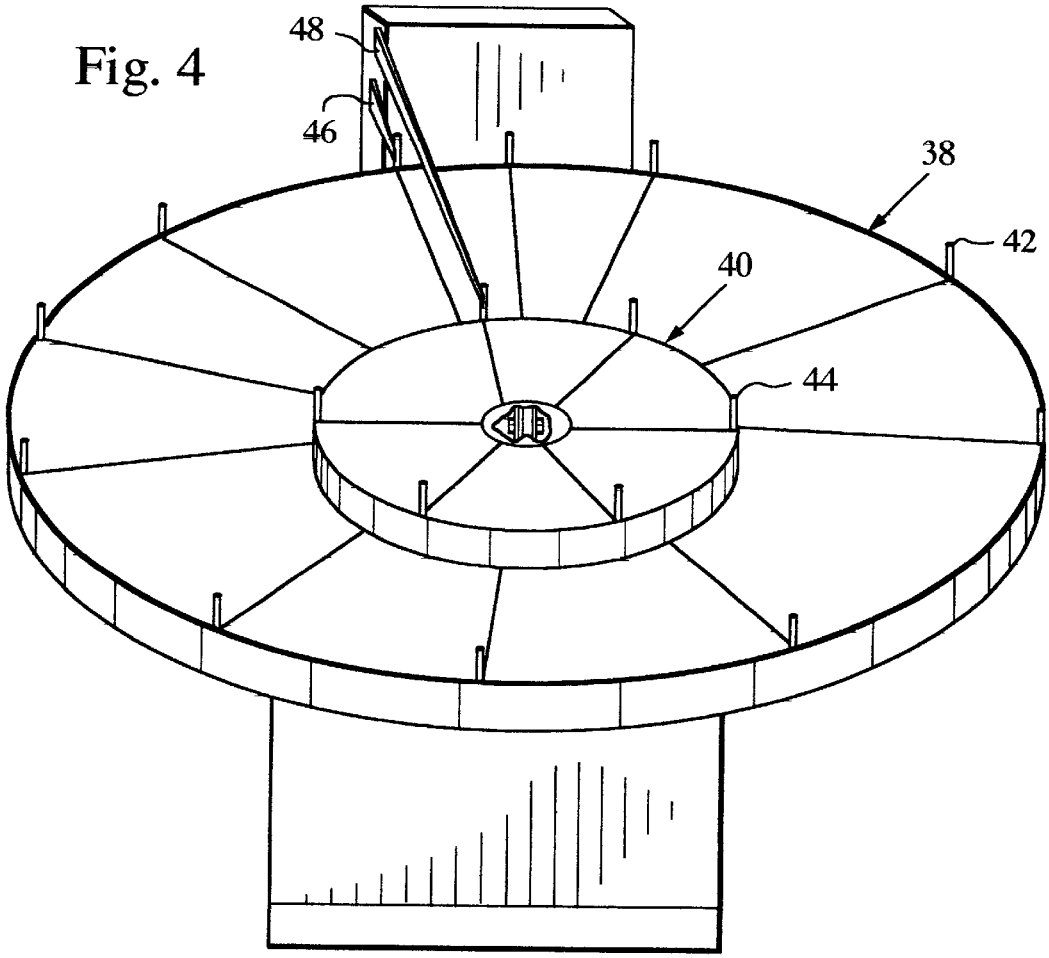
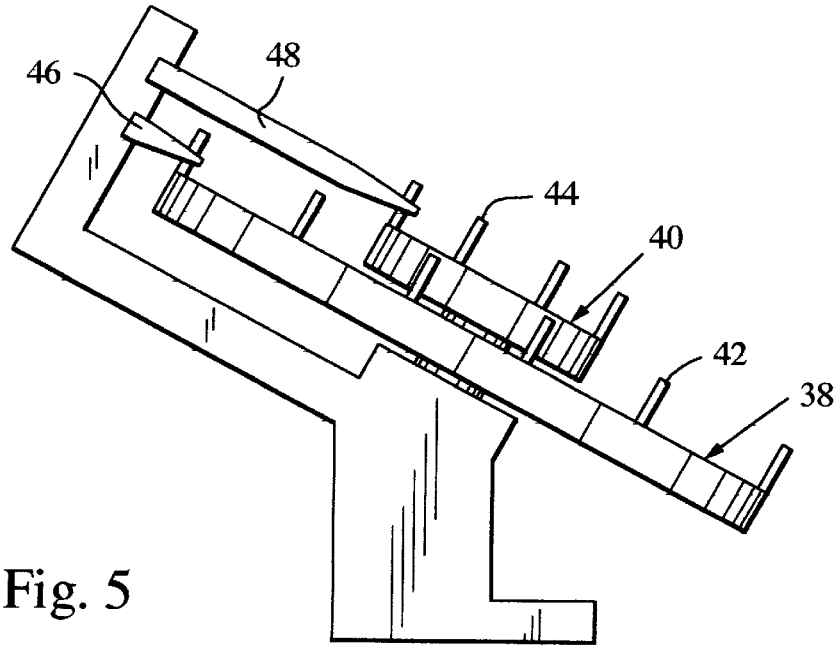
Fig. 5

GAME AND GAME TABLE

FIELD OF THE INVENTION

This invention is directed to a game and associated game table wherein a card game is first played to determine the play on a following winner wheel game. In the card playing portion of the game, one or more players play against a dealer, and it is the dealer who manages the collection and payoff of bets during the winner wheel portion of the game.

BACKGROUND OF THE INVENTION

Many well-known card games include both skill and chance, with the cards falling randomly to each player and the players employing skill to influence the outcome of the game.

There are also games which rely totally on chance, such as roulette. The roulette odds are well known because there is a known number of divisions on the wheel, and there is an equal chance of the indicator falling on any one of the divisions. The odds are set so that the house gets a beneficial share of the wagers by providing one or more wheel spaces for which there is no payoff.

It is desirable to combine both of these concepts so that successful card playing can positively influence the payoff odds of the wheel.

SUMMARY OF THE INVENTION

In order to aid in the understanding of this invention, it can be stated in essentially summary form that it is directed to a game and game table with the game table having provision for a first phase card game and the game table having provision for a second phase wheel game, with the outcome of the first phase card game influencing the second phase of the game.

It is, thus, a purpose and advantage of this invention to provide a game and game table which has a mutually integrated card game and wheel game which cooperate with each other to provide an interesting game of skill and chance.

It is another purpose and advantage of this invention to provide a first phase card game wherein cards are dealt to the players by a dealer, and the numeric values are added up toward a specified sum total, and when the sum total of any particular player's hand equals a predetermined value, then all of the players of that hand have a chance to bet on a random wheel spin.

It is another purpose and advantage of this invention to provide a game and game table wherein the second phase includes an odds wheel and a winner wheel, with the odds wheel being spun to randomly select odds and a winner wheel which randomly selects the winning space. In this way, each game varies in accordance with random selection of odds.

It is a further purpose and advance of this invention to provide a game system wherein a card game which has a skill component is cooperative with a random wheel game.

It is another purpose and advantage of this invention to provide a game and game table which provides pleasure for the players and economic benefit for the operator.

Other purposes and advantages of this invention will become apparent from a study of the following portion of the specification, the claims and the attached drawings.

BRIEF DESCRIPTION OF THE DRAWINGS

FIG. 4 is an enlarged front view of the winner wheel with the odds wheel superimposed thereon.

FIG. 5 is a side view of the winner wheel with the odds wheel superimposed thereon.

DESCRIPTION OF THE PREFERRED EMBODIMENT

Figure 1:
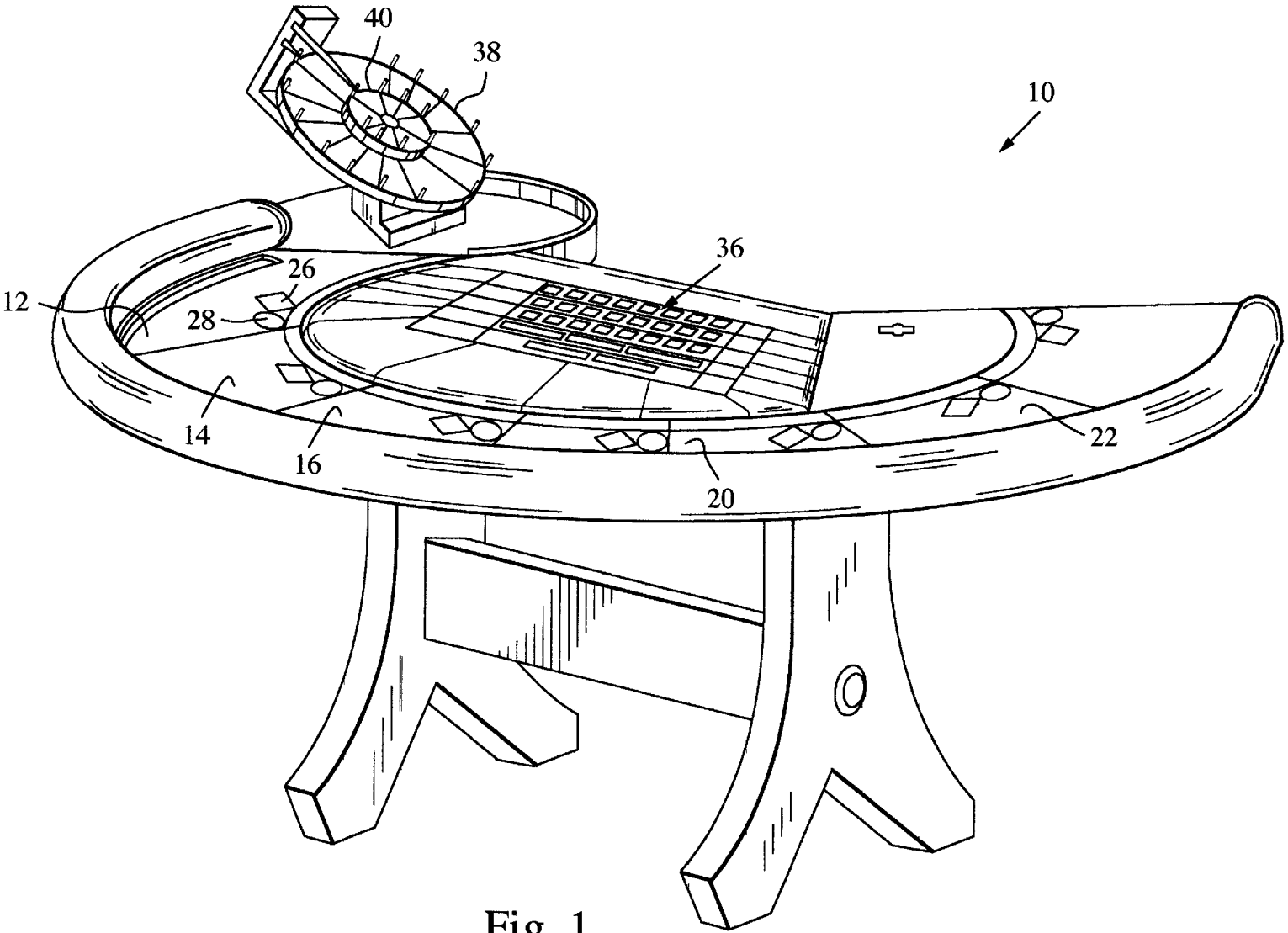
FIG. 1 is a perspective view of the game table of this invention.
Figure 2:
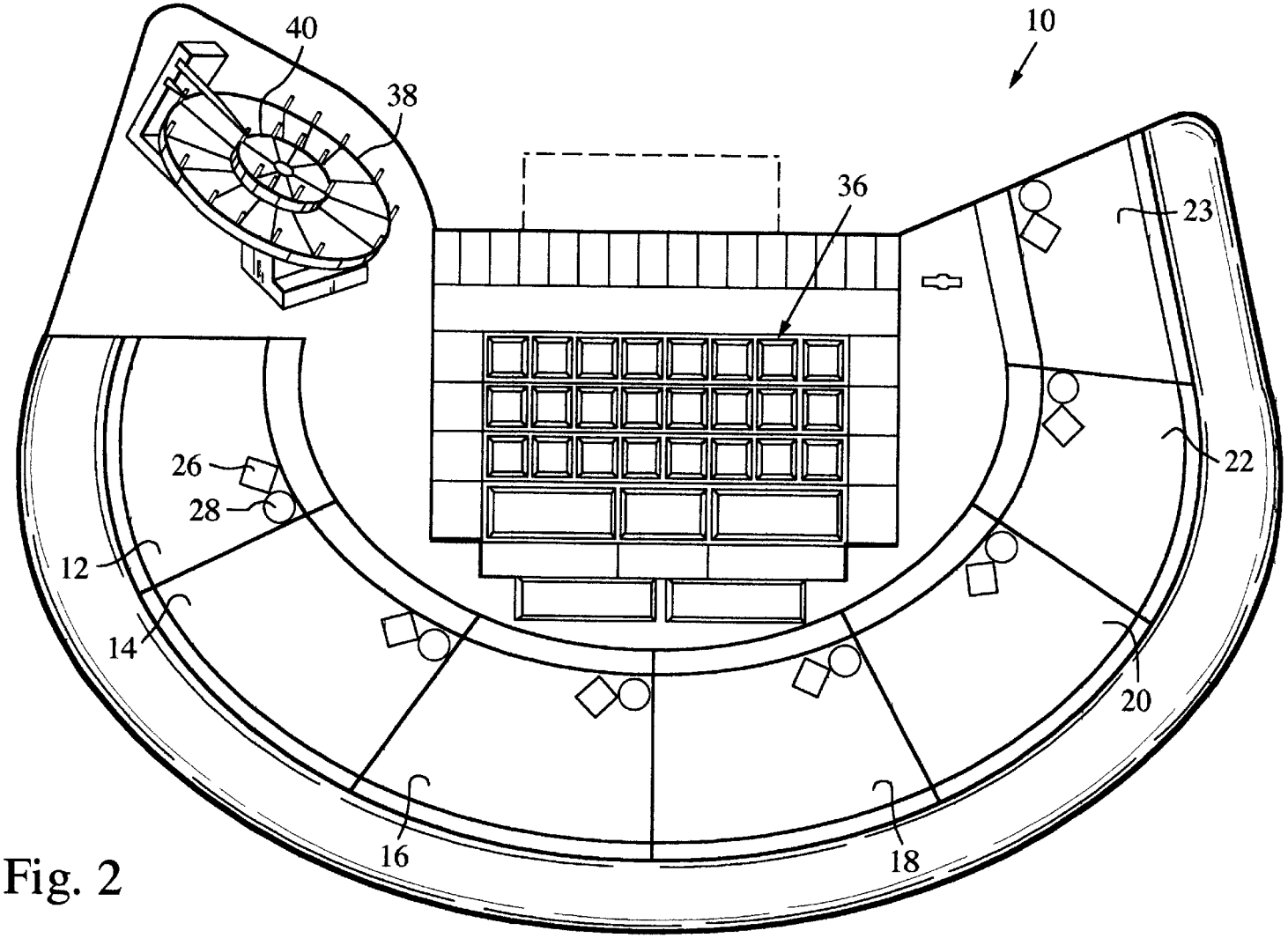
FIG. 2 is a plan view thereof.

Game table 10 is shown in FIGS. 1 and 2. The game table 12 has a plurality of outer playing zones of which seven zones 12, 14, 16, 18, 20, 22 and 23 are shown as an example, at which seven players can assemble. The playing zones are substantially flat surfaces at a convenient height so that the players may be seated around the table on chairs or stools. The front of the table, with the playing zones, is convexly curved. At the back of the table there is a recess 24 in which a dealer can be positioned. The game is particularly useful in a casino where the table is provided by the management and a dealer oversees the game. Each of the player areas has two ante areas. The dealer deals one card face-up to each of the players. The phase 1 ante area 26 must have an ante for that player to participate in the first phase of the game. If he also wishes to participate in the second phase of the game, he must ante in the second phase ante area 28 before the first phase begins.

Each person who wants to play occupies a space in front of his playing zone and antes up into the designated areas. There are two ante areas in each playing zone. The phase one game ante areas are diamond-shaped and, in zone 12, the phase one game ante area is designated by numeral 26.

When each person who wants to participate in the next phase one game has anted up, the dealer is ready to play the phase one game. However, before starting the game, anyone who wants to play the phase two portion of the game must ante up in the phase two ante area 28, which is shown as circular.

It is not required that the player ante for the second phase, but if the player does not, he cannot participate in the second phase. Presuming all antes are made, the dealer deals one card face-up to each of the players and one face-down to himself. The dealer then deals a second card face-up to each of the players and to himself. The card stock from which he deals is a conventional 52-card bridge deck. A plurality of decks may be shuffled together to minimize the effects of card counting. In the deck, each of the numbered cards has a value equal to its number; each of the face cards has a value of 10; and each of the aces has a value of either 1 or 11, as chosen by the player.

At this stage, the new numerical total of each hand is taken. If the numerical total of any one hand is 13, 14, 15or 16, that is a bonus hand. In counting for this total an ace is always valued one. The payoff to all players having that total will receive a two-to-one payoff on their phase 2 ante.

In addition to that payoff, if the first two cards of any one hand total 13, 14, 15 or 16, then the second phase can begin upon completion of the first phase. Without this new numerical opening, the second phase does not open and all second phase antes are forfeited. Whether or not the hand has reached this key total, phase 1 plays to completion with the same rules as a conventional game of "21" including double-down, insurance and the like.

The first phase of the game is completed when each of the players, including the dealer, draws as many cards as he desires. The dealer is constrained by house rules and is required to draw when his card count is 13 or less and is prohibited from drawing when his card count is 14 or more. At the completion of dealing, if the dealer's total is over 21, all players who have a count under 22 are winners and are paid off on a one-to-one basis. All players whose cards total more than 21 lose their ante, and all players whose card total is less than the dealer's lose their ante. Ties go to the dealer. All players who have a total in card count higher than the dealer and less than 22 receive a one-to-one payoff. If a total count of 21 is achieved by a player by a face card or 10 plus an Ace, the pay-off is one and one half to one. If the dealer achieves the same hand as the player, this player does not loose, but all others loose. This concludes the first phase of the game.

As previously stated, there is an ante area in each of the playing zones for the second phase portion or winner's wheel portion of the game. The phase 2 ante area for the playing zone 12 is indicated at 28. As seen in FIG. 2, there is an ante area for the phase 2 game in each of the playing zones. At the beginning of the game, if the player wishes to play the phase 2 portion of the game, he must also originally ante up into that circle.

At this stage of the game—transitioning from the first phase to the second phase—the player's ante from that square is changed into color chips which identify players on the player betting section 36. The players bet with the ante chip and/or chips from the player's stock. The bets are placed on the betting section 36 in front of the dealer. This betting section is seen in FIGS. 1 and 2 and is seen in more detail in FIG. 3.

Figure 3:
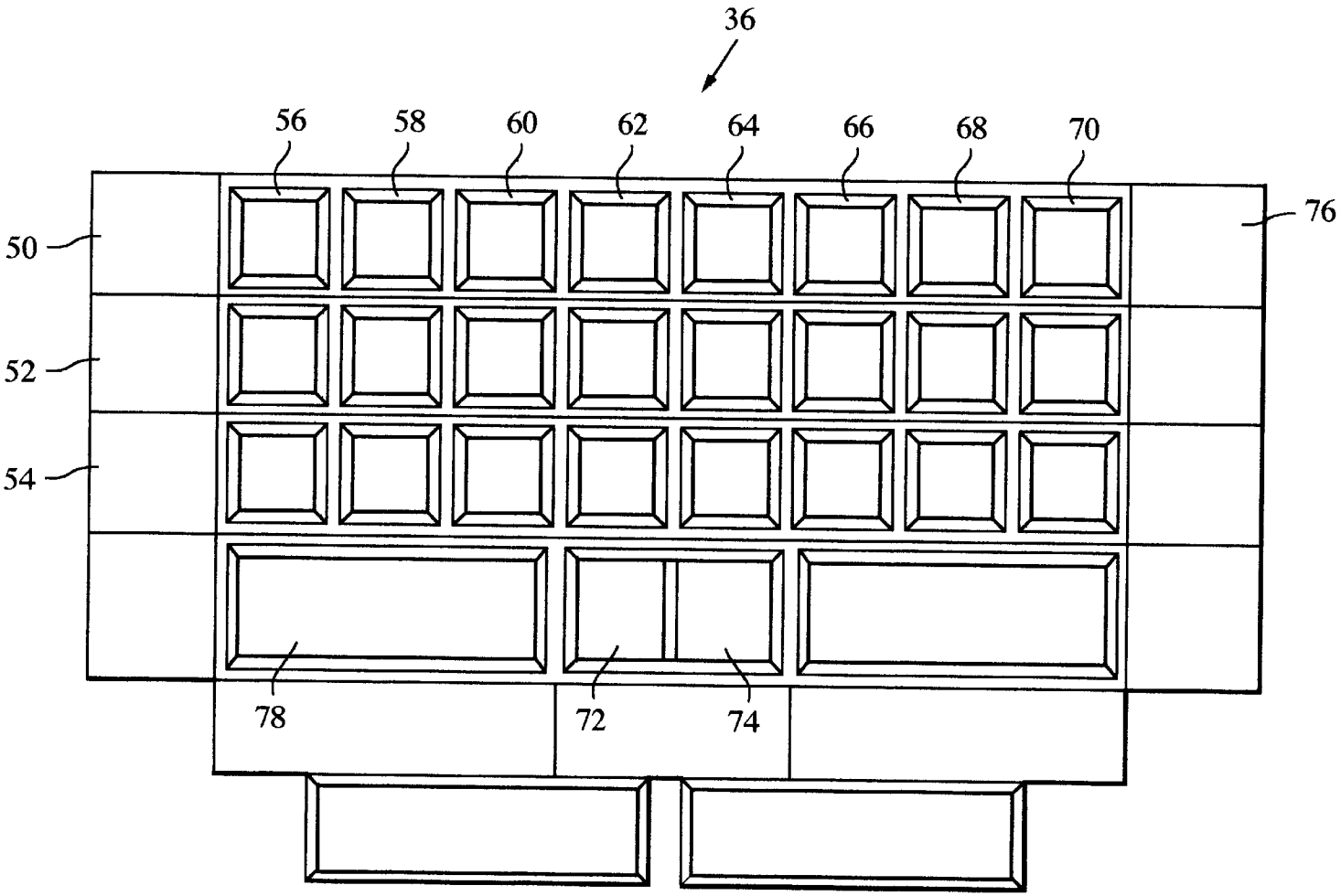
FIG. 3 is an enlarged view of the top of the game table showing the second phase bet placement areas.

In the second phase of the game, the winner wheel 38 and the odds wheel 40 are utilized. These wheels are both mounted on the table and may be mounted with a common axis, as shown in FIGS. 1, 2 and 3. The wheels are positioned so that they can be seen by both the players and the dealer. The wheels are preferably positioned with a wheel rotational axis from horizontal to 45 degrees above horizontal. The two wheels function separately even though they are spun at the same time and, thus, may be separately mounted. Each of the wheels has a plurality of segments, and the segments are separated by stop pins 42 and 44 on the winner wheel and odds wheel, respectively. There is a stop pin at the separation of each of the wheel segments.

Cooperating with the stop pins are flipper fingers 46 and 48, which resiliently extend into the circumferential path of the stop pins so that they are each deflected by the passage of the stop pins. The flipper fingers thus unambiguously indicate a particular segment when the wheels are stopped.

In the present example, the winner wheel 38 has twenty-eight spaces, which correspond to the twenty-six letters of the alphabet plus two bankrupt spaces or "house wins." This is the preferred number for this game, but a different total number and a different set of indicia can be employed if other odds are preferred. The betting section 36 has three rows 50, 52 and 54 of betting spaces and six columns of betting spaces 56, 58, 60, 62, 64, 66, 68 and 79 to define twenty-four of the alphabetically numbered spaces and two additional betting spaces 72 and 74 for the balance of the letters. Each of the rows has a betting space at each end which pays off if any of the letters in that row are randomly selected; for example, row betting space 76. This space wins if any one of the numbers in row 50 win. There are similar betting spaces for the rows 52 and 54. The left three columns, the right three columns and the center two columns have combined betting spaces therebelow. Betting space 78 is an example of a space that can be bet and which will win if any one of the numbers in columns 56, 58 and 60 is a winner. These spaces indicate a win if any of the letters in those particular columns are selected.

Each individual player who is still in the game, having played and won the first phase and anted up for the second phase takes his bet from the second phase ante area 34 and places it on a selected betting square on the betting section 36. He may select an individual space or may select particular rows or groups of columns, as previously described As is common in roulette, two different colors can be employed on the spaces in the winner's wheel 38 (except for the house segment), and the player may bet on a color. The winner wheel has the same number of segments as the betting section 36 has individual betting spaces. When the bets are placed, the dealer spins both the winner wheel 38 and the odds wheel 40. When the winner wheel 38 stops, either a selected letter or the house space is randomly selected. When the odds wheel 40 stops, the payoff odds ratio is selected. The spaces of the odds wheel are indicated with the odds 1×, 2×, 4×and 6×, where × means multiply the odds indicated on the table by this number.

Figure 6:
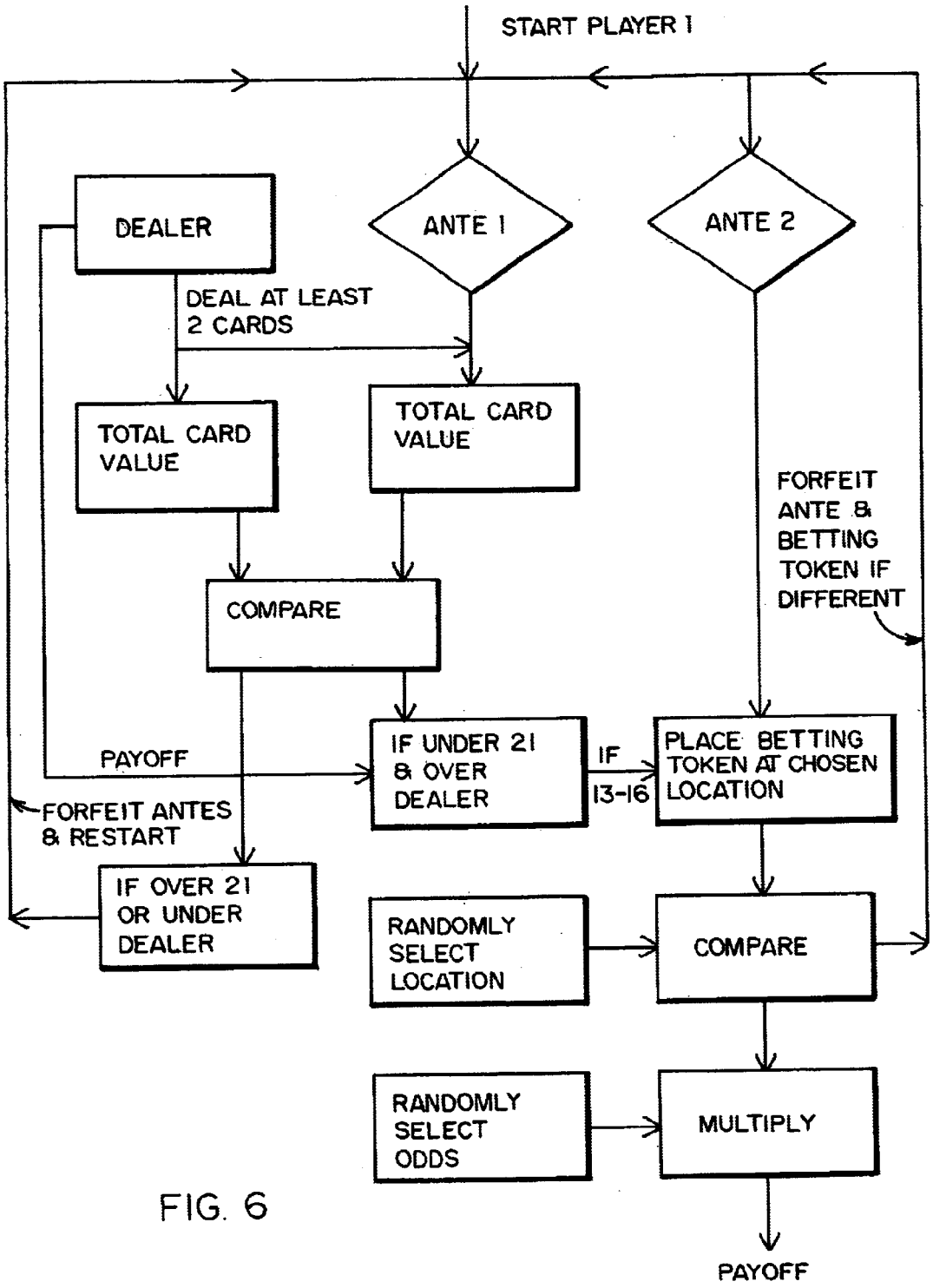
FIG. 6 is a flow diagram showing the logic and method step of the game of this invention.

These playing steps are visually shown in the flow chart of FIG. 6.

In the preferred embodiment, there may be four 1×spaces, two 2× spaces, two 4× spaces and one 6× space. These odds wheel numbers show the payoff multiplier. Other multipliers such as 3× and/or 5× may be added to the wheel with suitable odds adjustments in other parts of the game. Each of the individual betting spaces, each row and each set of columns is indicated with the normal 1× odds so that the odds wheel shows multiplication of the basic odds.

This invention has been described in its presently preferred embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A game table comprising:

a top surface on said game table, a plurality of first and second ante placement positions on said surface to define a plurality of player positions, said table top surface being configured for playing the first phase of a card game thereon;

a betting section on said table surface;

a first winner's wheel having a plurality of segments, each said segment corresponding to a position on said betting section on said surface; and a second odds wheel having a plurality of segments, said odds wheel indicating the odds multiplier for said winner's wheel so that said betting section and said first and second wheels can be employed in playing a second phase of the game.

2. The game table of claim 1 wherein said first and second wheels are concentric.

3. The game table of claim 1 wherein both said first and second wheels are mounted on said table.

4. The game table of claim 3 wherein said first and second wheels are concentric.

5. The game table of claim 1 wherein said first and second ante positions are differently configured from each other.

6. The game table of claim 1 wherein said betting section comprises a plurality of betting positions rectangularly arranged in rows and columns with each position corresponding to a segment on said winner's wheel.

7. The game table of claim 6 wherein there are further betting positions in said betting section in row alignment with said betting positions corresponding to wheel segments.

8. The game table of claim 6 wherein there is indicia on each of said betting positions and there is indicia on each of said segments of said winner's wheel, said indicia corresponding to each other so a particular segment of said winner's wheel corresponds to a particular segment of said betting section.

9. The game table of claim 8 wherein said first and second wheels are concentric.

10. The game table of claim 8 wherein both said first and second wheels are mounted on said table.

11. The game table of claim 1 further including a dealer's space, said dealer's space being accessible to each of said player spaces, said first and second wheels being accessible from said dealer's space.

12. The game table of claim 11 wherein said dealer's space faces said player's spaces.

13. The game table of claim 12 wherein said winner's wheel and said odds wheel are concentric on the same rotational axis, said rotational axis being between horizontal and 60 degrees above horizontal, both of said wheels having wheel spaces and said wheel spaces being visible to all of said player's spaces and to said dealer's space.

14. A game comprising the steps of:

providing a game table having a surface and having a betting section, together with providing a winner's wheel for randomly indicating a position in the betting section and an odds wheel for randomly selecting payoff odds;

anteing in first and second separate ante positions to play first and second phases of the game;

playing the first phase of the game by dealing out two playing cards from a bridge deck to each player;

determining whether the total value of the two cards dealt any one player totals a key number, with the key number triggering opening of the second phase of the game;

finishing the card game by evaluating total card values for any one player with respect to the total card value of the dealer;

initiating the second phase of the game by betting in a selected area of the betting section to indicate which winner's wheel position is being bet on; and spinning both the winner's wheel and odds wheel to determine the winning indicia and to determine the payoff odds on any winner.

15. The game of claim 14 further including:

reading the winning segment of the winner's wheel;

inspecting the betting section to determine if there are any winning bets;

determining the basic odds of each winning bet and;

multiplying those odds by the randomly selected odds multiplier indicated by the odds wheel.

16. The game of claim 14 further including the step of;

Triggering the second phase of the game when the key number obtained in a first phase of the game is 13, 14, 15 or 16.

17. The method of playing a game having first and second phases, comprising the steps of:

providing a table having a playing surface including player's spaces and a betting section having a plurality of betting positions, having a phase one ante position, having a phase two ante position and providing first and second wheels having structure which permits one of the wheel sections to be randomly selected, the first wheel having notation thereon corresponding to the notation on said betting section;

each player antes to the phase one ante position and the phase two ante position;

the dealer deals two cards face up from the bridge deck to each player and notes when the cards for any player total to a key number;

paying off the phase two ante of any player who has the key number;

dealing one card to each individual player as requested by the individual player in the attempt by the individual player to reach a card total less than 22 and above the dealer's card numerical total;

initiating phase two of the game by soliciting bets on the betting section and when betting is completed, spinning both said first and second wheels so that said first wheel randomly designates a betting area on the betting section and the second wheel determines the odds for payoff of successful choosing the randomly selected betting section.

18. The method of claim 17 including the step of positioning the first and second wheels so that they are visible to the game players and the dealer and they are accessible to the dealer for spinning thereof.

19. The game of claim 18 including the step of positioning the betting section and the player's ante positions so that they are accessible to the dealer.

20. The game of claim 17 including the step of designating the winner's wheel segments and the betting section positions with the same indicia.

* * * * *